US010873144B2

(12) United States Patent
Shimada et al.

(10) Patent No.: US 10,873,144 B2
(45) Date of Patent: Dec. 22, 2020

(54) ELECTRICAL CONNECTOR

(71) Applicant: I-PEX Inc., Kyoto (JP)

(72) Inventors: Yoshinobu Shimada, Ogori (JP); Hirotake Kaneko, Ogori (JP)

( * ) Notice: Subject to any disclaimer, the term of this patent is extended or adjusted under 35 U.S.C. 154(b) by 0 days.

(21) Appl. No.: 16/367,263

(22) Filed: Mar. 28, 2019

(65) Prior Publication Data

US 2019/0305454 A1 Oct. 3, 2019

(30) Foreign Application Priority Data

Mar. 29, 2018 (JP) ..... 2018-065126

(51) Int. Cl.
*H01R 12/73* (2011.01)
*H01R 12/72* (2011.01)

(52) U.S. Cl.
CPC ..... *H01R 12/73* (2013.01); *H01R 12/721* (2013.01)

(58) Field of Classification Search
CPC ..... H01R 12/721; H01R 12/73
See application file for complete search history.

(56) References Cited

U.S. PATENT DOCUMENTS 7,134,912 B2 * 11/2006 Kamata ..... H01R 23/6873 439/607.31
7,427,211 B2 * 9/2008 Yoshikai ..... H01R 12/79 439/495
7,682,184 B2 * 3/2010 Ko ..... H01R 12/594 439/495
8,444,438 B2 * 5/2013 Gao ..... H01R 13/6582 439/607.35
8,608,509 B2 * 12/2013 Shimada ..... H01R 12/774 439/607.01
9,065,210 B2 * 6/2015 Narita ..... H01R 12/774
9,401,554 B2 * 7/2016 Takane ..... H01R 12/79
10,566,721 B2 * 2/2020 Nakajima ..... H01R 12/79
2012/0208385 A1 8/2012 Ozeki
2019/0305454 A1 * 10/2019 Shimada ..... H01R 12/721

FOREIGN PATENT DOCUMENTS

| | | |
|---|---|---|
| CN | 1988282 | 6/2007 |
| JP | 2004-213917 | 7/2004 |
| JP | 2008-192574 | 8/2008 |
| JP | 2012-169099 | 9/2012 |
| JP | 2014-022214 | 2/2014 |

* cited by examiner

*Primary Examiner* — Briggitte R. Hammond
(74) *Attorney, Agent, or Firm* — Soei Patent & Law Firm

(57) ABSTRACT

An electrical connector includes a plurality of conductive terminals, an insulating housing that holds the plurality of conductive terminals and that has an accommodating portion to accommodate a flexible printed circuit provided with a plurality of connection terminal portions electrically connected to the plurality of conductive terminals. A metallic reinforcing portion is located in an upper wall portion of a main body portion of the housing that partitions the accommodating portion.

20 Claims, 16 Drawing Sheets

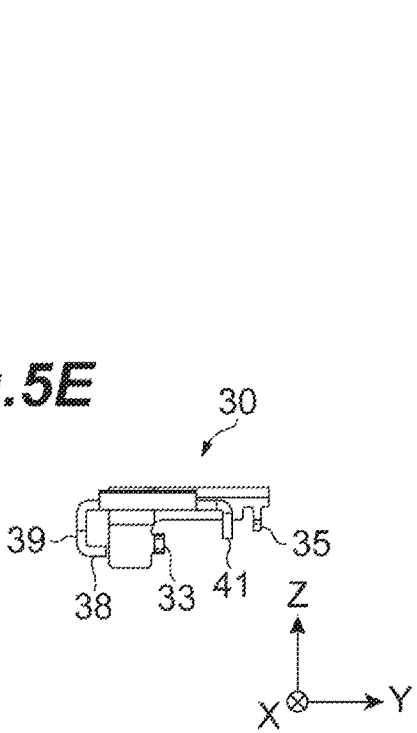
Fig.5E
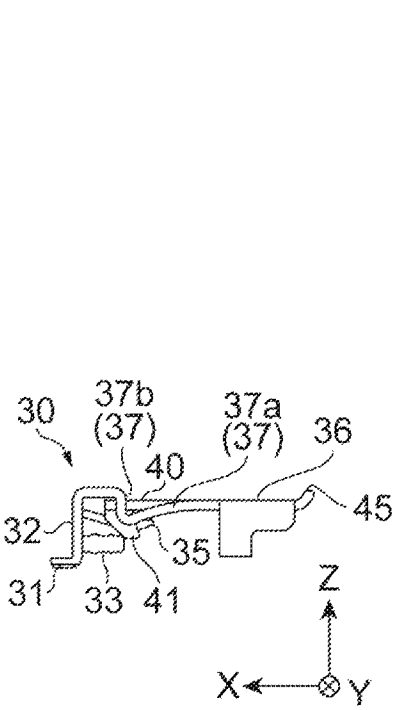
Fig.5D
Fig.5A
Fig.5B
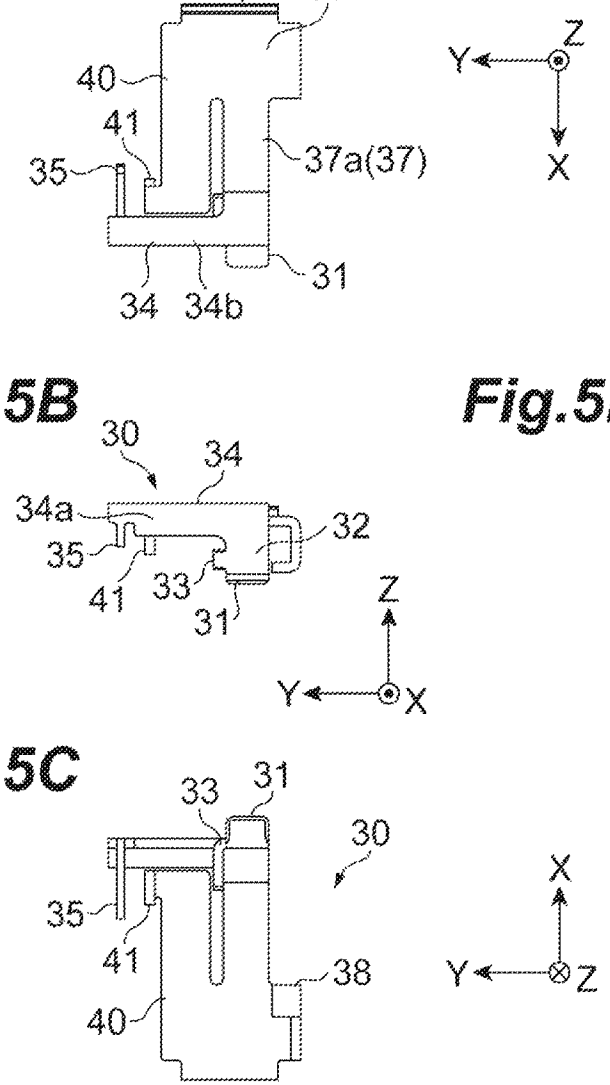
Fig.5C

ELECTRICAL CONNECTOR

CROSS-REFERENCE TO RELATED APPLICATION

This application is based upon and claims the benefit of priority from Japanese Patent Application No. 2018-065126, filed on Mar. 29, 2018, the entire contents of which are incorporated herein by reference.

TECHNICAL FIELD

The present disclosure relates to an electrical connector.

BACKGROUND

Japanese Unexamined Patent Publication No. 2014-22214 discloses an electrical connector in which an insertion portion is formed in a housing that holds a plurality of contacts and a plate-shaped connection object such as flexible printed circuits (FPC) is accommodated in the insertion portion.

SUMMARY

In the electrical connector disclosed in the above Japanese Unexamined Patent Publication No. 201422214, an upheaved connection object comes into contact with the housing and then a strong force is applied to the housing and the electrical connector (housing to be specific) may be damaged in a case where a terminal part of the accommodated connection object is lifted in the upward direction, that is, in a case where so-called upheaval occurs. The upheaval may become more pronounced as the height of the electrical connector is reduced. In this regard, the present disclosure describes an electrical connector capable of suppressing damage attributable to connection object upheaval.

An example electrical connector disclosed herein may include one or more contacts, an insulating housing holding the one or more contacts and including an accommodating portion accommodating a plate-shaped connection object provided with one or more connection terminal portions electrically connected to the one or more contacts, and a metallic reinforcing portion provided in an upper wall portion of the housing partitioning the accommodating portion.

In an electrical connector accommodating a connection object such as an FPC, a strong force may be applied to the housing of the electrical connector. In some examples, the metallic reinforcing portion is provided in the upper wall portion in the wall portion of the housing partitioning the accommodating portion. As a result, the force that is attributable to upheaval of the terminal part of the connection object in the upward direction can be received by the reinforcing portion as well as the housing, and thus damage to the electrical connector attributable to upheaval of the connection object in the upward direction can be suppressed or avoided.

The reinforcing portion may be provided on a surface of the housing where an opening of the accommodating portion is formed. When the connection object is upheaved, the connection object is likely to come into contact with the upper wall portion on the surface where the opening of the accommodating portion is formed. In this regard, the reinforcing portion is provided on the surface where the opening of the accommodating portion is foamed. Accordingly, the force that is applied to the electrical connector when the connection object is upheaved can be received by the reinforcing portion and damage to the electrical connector can be suppressed or avoided.

The reinforcing portion may be provided in both end portions of the opening-formed surface in a width direction, the width direction being an extension direction of the upper wall portion. By including the reinforcing portion in both width-direction end portions of the upper wall portion, the force that is applied to the upper wall portion when the connection object is upheaved can be received in a balanced manner by the reinforcing portion. In addition, the reinforcing portion may be provided in both end portions in a configuration in which the connection terminal portion is provided at the width-direction middle part of the connection object, so that contact between the one or more contacts and the connection terminal portion is not hindered.

The reinforcing portion may include a pair of first reinforcing members provided in both width-direction end portions of the opening-formed surface and a second reinforcing member extending in the width direction so as to interconnect the pair of first reinforcing members. As a result, when the connection object is upheaved, the force that is applied to both end portions of the upper wall portion can be received by the pair of first reinforcing members and the force that is applied to the middle portion of the upper wall portion can be received by the second reinforcing member. Additionally, the force that is applied to the upper wall portion can be received in a more balanced manner by the reinforcing portion, and damage to the electrical connector can be suppressed or avoided. In some examples, the width-direction length of the housing may be increased according to the number of contacts to further balance, dissipate, distribute or otherwise alleviate the force that is received.

The reinforcing portion may further include a third reinforcing member located contiguously with the second reinforcing member and covering an upper surface of the upper wall portion. As a result, the upper wall portion to which a force is applied when the connection object is upheaved can be reinforced.

The reinforcing portion may extend in a direction perpendicular to a main surface of the connection object. Since the reinforcing portion stretches in the direction of upheaval of the connection object (the perpendicular direction described above), rigidity can be enhanced against the force that is applied to the electrical connector as a result of upheaval of the connection object.

The reinforcing portion may include a part extending downward beyond a lower end of the upper wall portion. As a result, the reinforcing portion comes into contact with the connection object prior to the housing (upper wall portion) when the connection object is upheaved in the upward direction. Accordingly, the reinforcing portion may receive the force that is attributable to upheaval of the connection object in the upward direction and damage to the electrical connector (housing to be specific) can be suppressed or avoided.

The reinforcing portion may be selectively located above a lower end of the upper wall portion so that the reinforcing portion does not hinder the insertion of a connection object into the accommodating portion while maintaining the strength of the electrical connector.

The reinforcing portion may be formed in a fixing metal fitting configured to fix the housing to a substrate while reducing the number of parts.

The fixing metal fitting may have a locking portion configured to lock the connection object in the accommodating portion and an operation portion configured to release a locked state where the connection object is locked by the locking portion in order to maintain a connection with the accommodating portion at a time when the connection object is upheaved.

BRIEF DESCRIPTION OF THE DRAWINGS

FIGS. 2A to 2E are views illustrating the electrical connector illustrated in FIG. 1, in which FIG. 2A is a plan view, FIG. 2B is a front view, FIG. 2C is a bottom view, FIG. 2D is a side view, and FIG. 2E is a rear view.

FIGS. 3A to 3E are views illustrating an example housing included in the electrical connector illustrated in FIG. 1, in which FIG. 3A is a plan view, FIG. 3B is a front view, FIG. 3C is a bottom view, FIG. 3D is a side view, and FIG. 3E is a rear view.

FIGS. 4A and 4B are views illustrating the housing included in the electrical connector illustrated in FIG. 1, in which FIG. 4A is a top perspective view and FIG. 4B is a bottom perspective view.

FIGS. 5A to 5E are views illustrating an example fixing metal fitting included in the electrical connector illustrated in FIG. 1, in which FIG. 5A is a plan view, FIG. 5B is a front view, FIG. 5C is a bottom view, FIG. 5D is a side view, and FIG. 5E is a rear view.

FIGS. 6A and 6B are views illustrating the fixing metal fitting included in the electrical connector illustrated in FIG. 1, in which FIG. 6A is a top perspective view and FIG. 6B is a bottom perspective view.

FIGS. 7A to 7C are views illustrating an example locked state regarding unlocking by means of an operation portion, in which FIG. 7A is a front view, FIG. 7B is a cross-sectional view taken along line b-b of FIG. 7A, and FIG. 7C is a side view.

FIGS. 8A to 8C are views illustrating an example unlocked state regarding the unlocking by means of the operation portion, in which FIG. 8A is a front view, FIG. 8B is a cross-sectional view taken along line b-b of FIG. 8A, and FIG. 8C is a side view.

FIGS. 9A and 9B are views illustrating an example FPC, in which FIG. 9A is a plan view and FIG. 9B is a bottom view.

FIGS. 11A to 11D are views illustrating the connection between an example conductive terminal of the electrical connector and an example connection terminal portion of the FPC, in which FIG. 11A is a front view of the electrical connector prior to FPC insertion, FIG. 11B is a cross-sectional view taken along line b-b of FIG. 11A, FIG. 11C is a front view of the electrical connector in which the FPC is inserted, and FIG. 11D is a cross-sectional view taken along line d-d of FIG. 11C.

FIGS. 13A to 13D are views illustrating a locking operation of the FPC, in which FIG. 13A is a front view of the electrical connector in a state where the FPC is locked by the locking portion, FIG. 13B is a cross-sectional view taken along line b-b of FIG. 13A, FIG. 13C is a front view of the electrical connector in an unlocked state, and FIG. 13D is a cross-sectional view taken along line d-d of FIG. 13C.

FIGS. 14A to 14D are views illustrating the connection between an example ground contact portion of the electrical connector and an example ground terminal portion of the FPC, in which FIG. 14A is a front view of the electrical connector prior to FPC insertion, FIG. 14B is a cross-sectional view taken along line b-b of FIG. 14A, FIG. 14C is a front view of the electrical connector in a state where the ground contact portion and the ground terminal portion are interconnected, and FIG. 14D is a cross-sectional view taken along line d-d of FIG. 14C.

FIGS. 15A and 15B are perspective views illustrating an example electrical connector, in which FIG. 15A is a top perspective view and FIG. 15B is a bottom perspective view.

FIGS. 16A to 16E are views illustrating the electrical connector illustrated in FIGS. 15A and 15B, in which FIG. 16A is a rear view, FIG. 16B is a plan view, FIG. 16C is a front view, FIG. 16D is a bottom view, and FIG. 16E is a side view.

DETAILED DESCRIPTION

Figure 1:
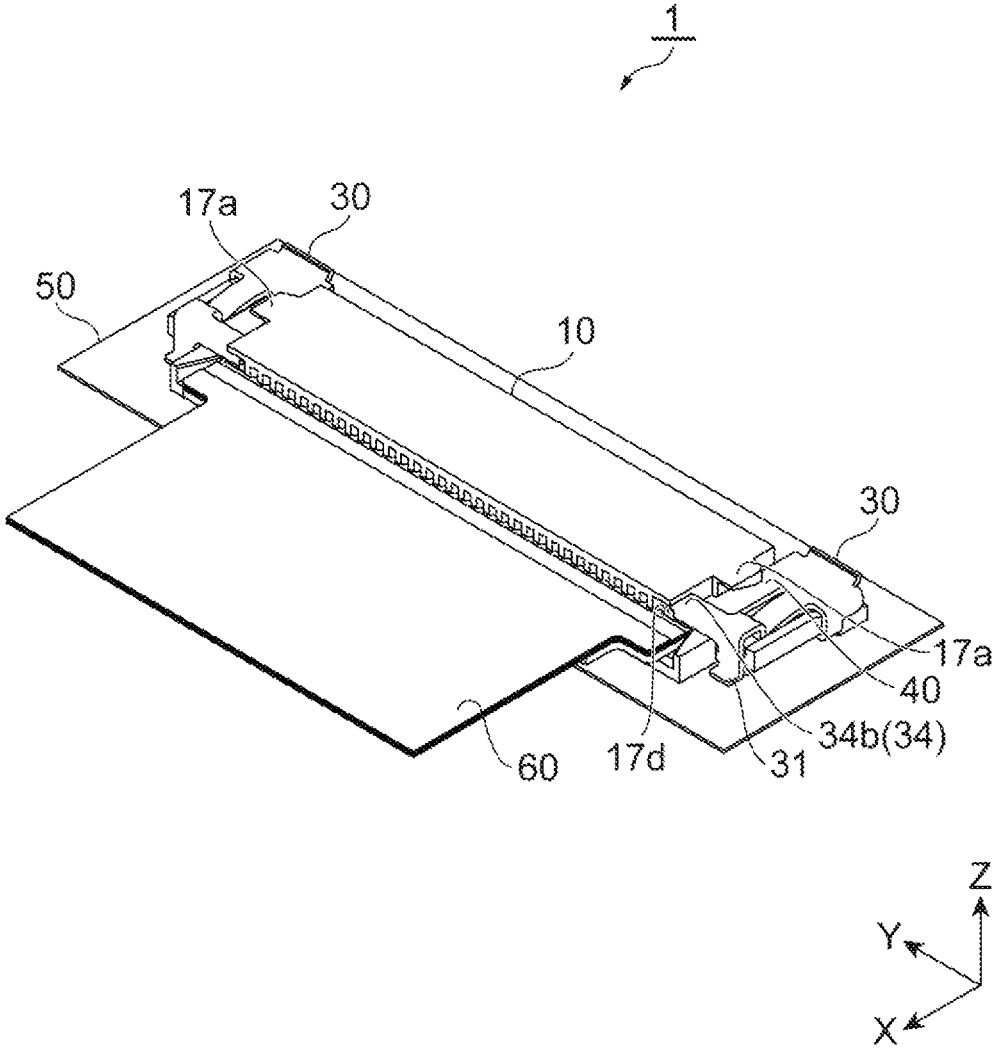
FIG. 1 is a perspective view of an example electrical connector.
Figure 2A:
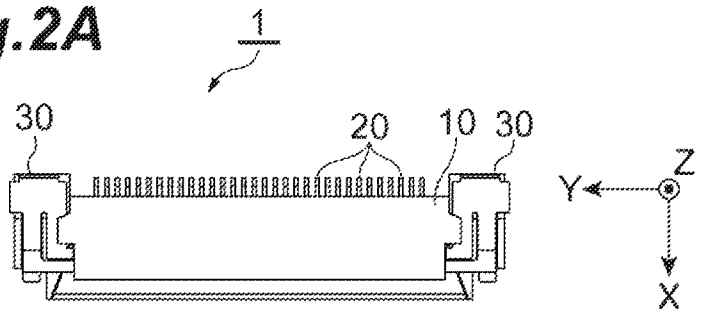
Figure 2B:
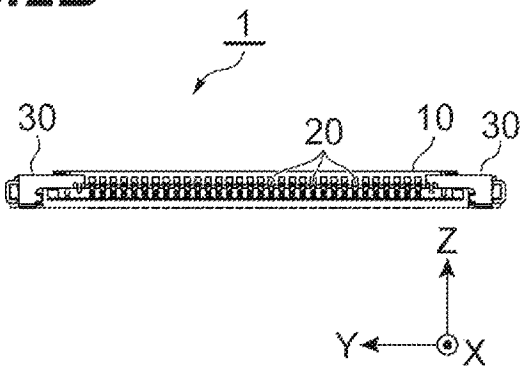
Figure 2C:
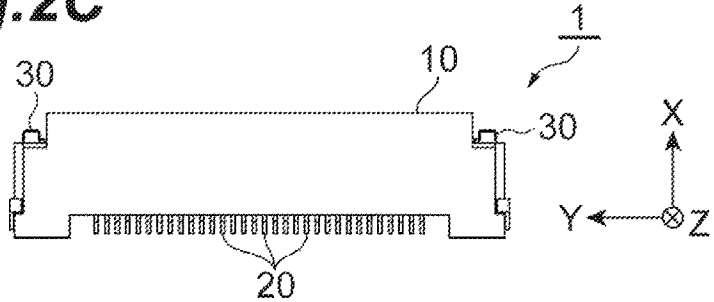
Figure 2E:
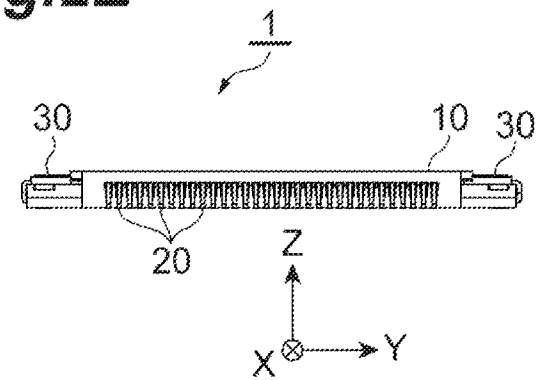
Figure 2D:
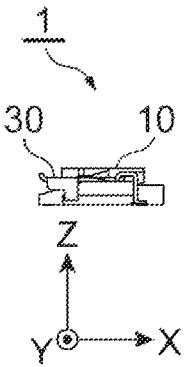

In the following description, with reference to the drawings, the same reference numbers are assigned to the same components or to similar components having the same function, and overlapping description is omitted.

(Outline of Electrical Connector)

As illustrated in FIG. 1 and FIGS. 2A to 2E, an example electrical connector 1 includes a housing 10, a plurality of conductive terminals 20 (contacts), and fixing metal fittings 30. The electrical connector 1 is placed on a wiring substrate 50 and is electrically connected to the wiring substrate 50. In addition, the electrical connector 1 is configured to accommodate flexible printed circuits (FPC) 60 and is electrically connected to the FPC 60. In this manner, the electrical connector 1 has the function of accommodating the FPC 60 and electrically interconnecting the wiring substrate 50 and the FPC 60 in a state where the electrical connector 1 is placed on the wiring substrate 50.

In some of the following examples, the longitudinal direction of the electrical connector 1 is referred to as "Y direction", the short direction (width direction) of the electrical connector 1 is referred to as "X direction", and the height direction of the electrical connector 1 (direction orthogonal to the main surfaces of the wiring substrate 50 and the FPC 60) is referred to as "Z direction". Regarding the Z direction, the wiring substrate 50 side as viewed from the electrical connector 1 may be referred to as the "lower side" and the electrical connector 1 side as viewed from the wiring substrate 50 may be referred to as the "upper side". Regarding the X direction in the description of the configuration of the electrical connector 1, the front at a time when the FPC 60 is inserted into an accommodating portion 18 may be referred to as the "front" and the back that is opposite to the front may be referred to as the "rear".

(Housing and Conductive Terminal)

Next, the housing 10 and the plurality of conductive terminals 20 will be described in further detail with reference to FIGS. 3A to 3E and FIGS. 4A and 4B.

The housing 10 is placed on the wiring substrate 50 and is configured to accommodate the FPC 60 (see FIG. 1). The housing 10 is an insulating member that holds the plurality of conductive terminals and has the accommodating portion 18 (see FIG. 4A) accommodating the plate-shaped FPC 60 (see FIG. 9A) provided with a plurality of connection terminal portions 61 electrically connected to the plurality of conductive terminals 20. As illustrated in FIGS. 3A to 3E and FIGS. 4A and 4B, the housing 10 has a main body portion 11 (wall portion) and fixing portions 12 located contiguously at both end portions of the main body portion 11 in the Y direction. The main body portion 11 of the housing 10 and the plurality of conductive terminals 20 will be described first, and then the fixing portions 12 will be described in further detail later.

The main body portion 11 is made of a resin-containing insulating material. The main body portion 11 has a substantially rectangular parallelepiped shape extending in a predetermined direction. The main body portion 11 has a bottom wall portion 13, side wall portions 14, 15, and 16, an upper wall portion 17, and the accommodating portion 18 (see FIG. 4A). The bottom wall portion 13 is a plate-shaped body having a substantially rectangular shape. The bottom wall portion 13 is formed so as to have a wall thickness gradually decreasing (length decreasing in the Z direction) toward the front end at the front end part of the bottom wall portion 13 (see FIG. 4A). As a result, insertion of the FPC 60 (see FIG. 1) into the accommodating portion 18 is facilitated.

Each of the side wall portions 14, 15, and 16 is provided on the bottom wall portion 13 in a state of being upright with respect to the bottom wall portion 13. The side wall portions 14 and 15 are respectively positioned near the short sides of the substantially rectangular bottom wall portion 13 and extend in the X direction along the short sides. Accordingly, the side wall portions 14 and 15 face each other in the Y direction. The front end parts of the side wall portions 14 and 15 are formed so as to spread outward (outward in the Y direction) by means of a gradual decrease in wall thickness toward the front end (see FIG. 4A). As a result, an opening 18*a* of the accommodating portion 18, which will be described in further detail later, is widened and insertion of the FPC 60 (see FIG. 1) into the accommodating portion 18 is facilitated.

The side wall portion 16 is positioned near the long side of the rear end of the bottom wall portion 13 and extends in the Y direction along the long side. The side wall portion 16 has a through hole 16*a* having a size corresponding to the shape of the conductive terminal 20 in the region where the plurality of conductive terminals 20 are provided (see FIG. 3E). In some examples, through holes 16*a* penetrating the side wall portion 16 in the X direction and equal in number to the conductive terminals 20 are formed along the Y direction in the side wall portion 16. Additionally, in some examples, no side wall portions are formed on the long side near the front end of the bottom wall portion 13.

Figure 3A:
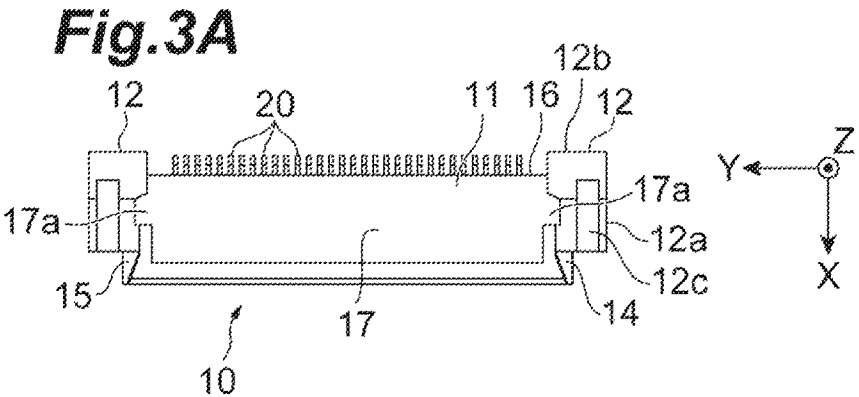
Figure 3E:
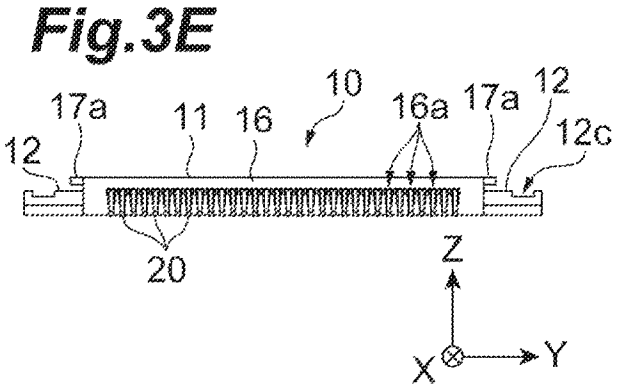

The upper wall portion 17 is a plate-shaped body having a substantially rectangular shape and is provided so as to face the bottom wall portion 13 in the Z direction. The upper wall portion 17 may be located contiguously with substantially the entire Y-direction region of the upper end of the side wall portion 16 and may extend forward (forward in the X direction) from the side wall portion 16 (see FIG. 4A). The front end of the upper wall portion 17 is positioned behind the front end of the bottom wall portion 13 (see FIG. 3A). The upper wall portion 17 has extending portions 17*a* and 17*a* at both Y-direction ends of the X-direction middle part of the upper wall portion 17 and the extending portions 17*a* extend outward in the Y direction (for example, toward the side wall portions 14 and 15 as illustrated in FIGS. 3A and 4A). The extending portions 17*a* are parts with which a fourth intermediate portion 40 of the fixing metal fitting 30 is sandwiched between the fixing portions 12 and the fixing metal fitting 30 is prevented from escaping upward (see FIG. 1).

Figure 12A:
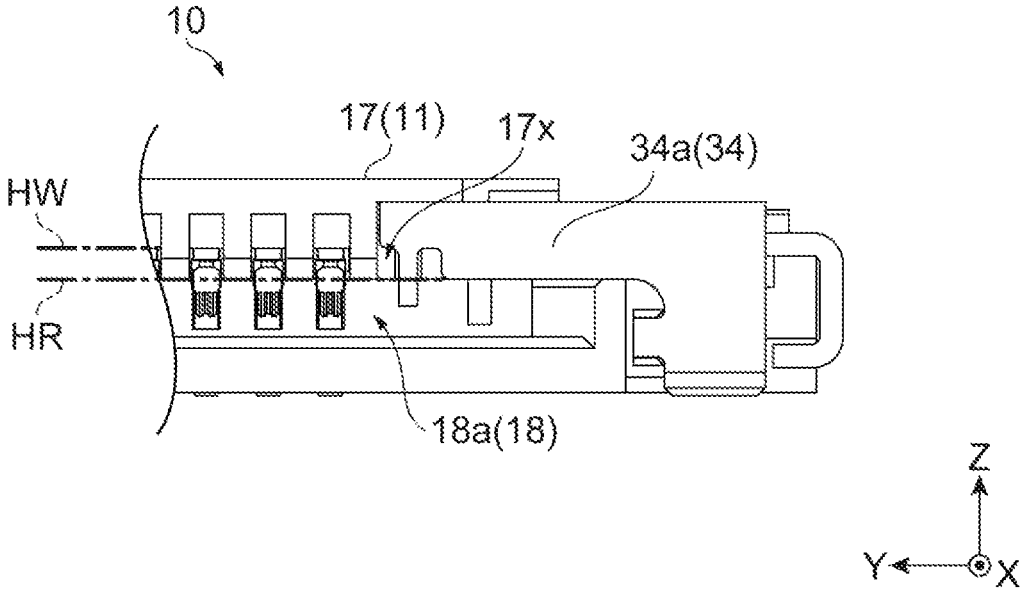
FIG. 12A is an enlarged view of the XIIa region illustrated in FIG. 11A
Figure 12B:
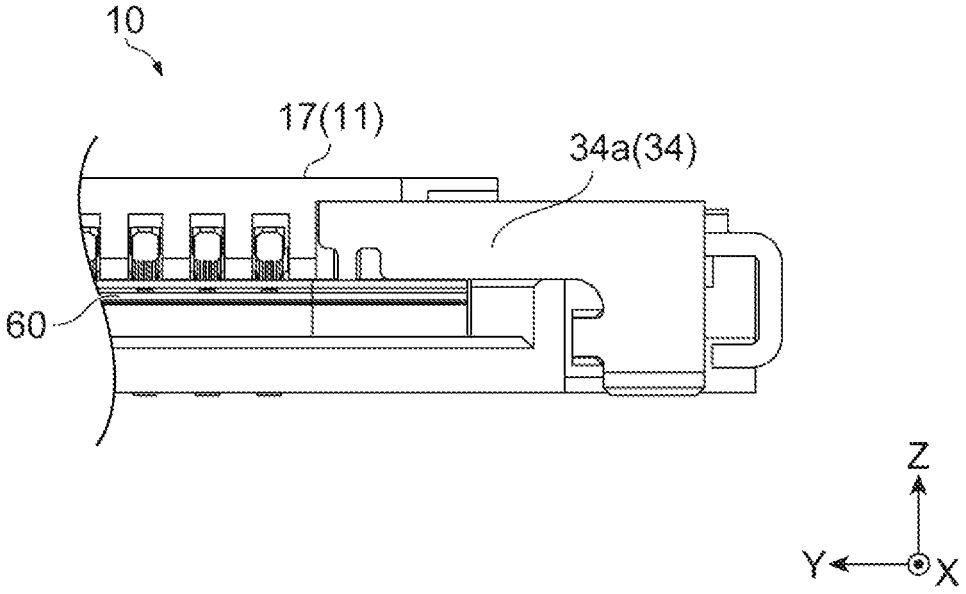
FIG. 12B is an enlarged view of the XIIb region illustrated in FIG. 11C.

In addition, an accommodating space 17*x* as a space accommodating a reinforcing portion 34 of the fixing metal fitting 30 is formed at both Y-direction ends of the front end of the upper wall portion 17 as illustrated in FIG. 12A. As illustrated in FIG. 4A, the accommodating space 17*x* is provided with a first part 17*c* extending downward and a second part 17*d* extending forward from the lower end of the first part 17*c*. Placed on the upper surface of the second part 17*d* is a second part 34*b* of the reinforcing portion 34 of the fixing metal fitting 30 (see FIG. 1).

Figure 3B:
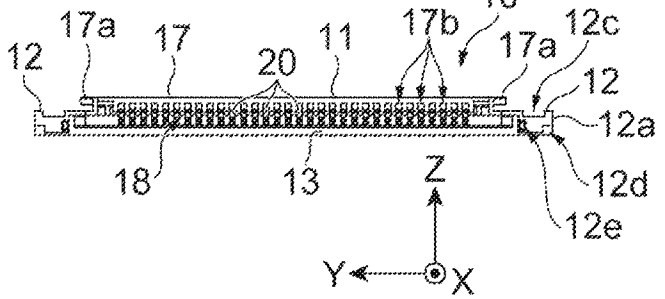
Figure 3C:
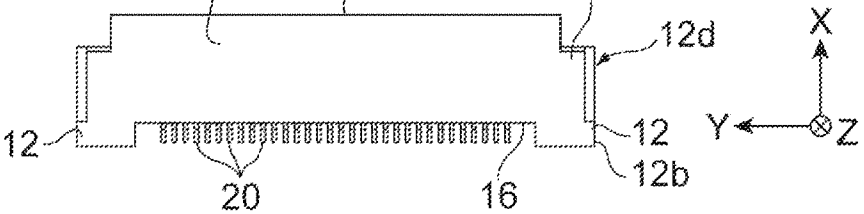
Figure 3D:
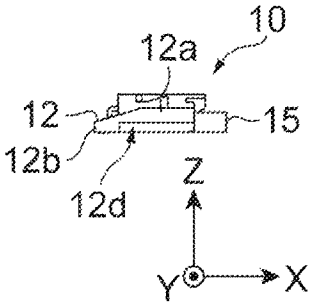
Figure 11A:
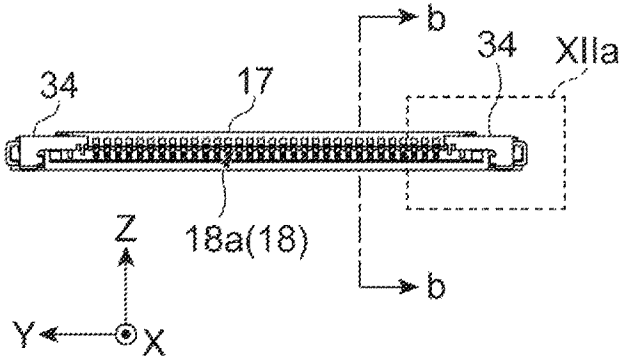
Figure 11B:
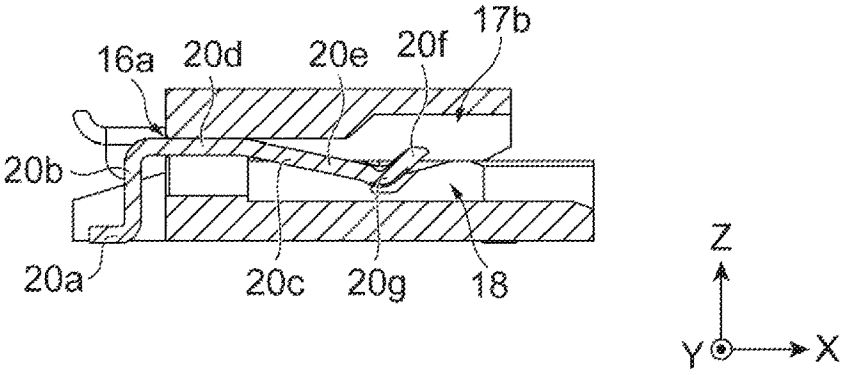
Figure 11C:
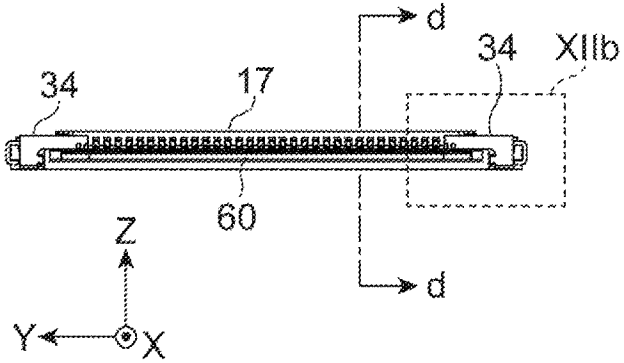

The upper wall portion 17 has an accommodating recess 17*b* for positioning the conductive terminal 20 in the region where the plurality of conductive terminals 20 are provided (see FIGS. 3B, 4A, and 11B). The accommodating recess 17*b* is formed along the Y direction in the upper wall portion 17 and is equal in number to the conductive terminal 20. The accommodating recess 17*b* is a recess formed in the Z direction in the upper wall portion 17. The front part of the upper wall portion 17 (see FIG. 11B) is formed so as to have a small wall thickness such that the conductive terminal 20 and the upper wall portion 17 do not come into contact with each other when the FPC 60 is inserted in the accommodating portion 18.

The accommodating portion 18 is a space formed by the bottom wall portion 13, the side wall portions 14, 15, and 16, and the upper wall portion 17. The accommodating portion 18 is a part where the FPC 60 (see FIG. 1) is accommodated. The opening 18*a* (see FIG. 4A), which is an insertion port for the FPC 60, is formed at the front end part of the accommodating portion 18, that is, between the front end of the upper wall portion 17 and the bottom wall portion 13. The accommodating portion 18 has a size at which the region where the connection terminal portion 61 (see FIG. 9A) of the FPC 60 is formed fits within the accommodating portion 18.

The plurality of conductive terminals 20 (e.g., 32 conductive terminals) are attached to the side wall portion 16 and pay be partially located in the accommodating portion 18. In the side wall portion 16, the plurality of conductive terminals 20 are arranged in a row in the extension direction of the side wall portion 16 (Y direction).

The conductive terminal 20 is made of a plate-shaped conductive material (such as a metal member). The conductive terminal 20 has a proximal end portion 20*a*, an intermediate portion 20*b*, and a contact portion 20*c* (see FIGS. 11B and 11D). The proximal end portion 20*a* is a part positioned behind the side wall portion 16 and extends in the X direction (rearward) in the vicinity of the bottom wall portion 13. The proximal end portion 20*a* is connected by solder or the like to an electrode of the wiring substrate 50 when the electrical connector 1 is mounted on the wiring substrate 50. The intermediate portion 20*b* is located contiguously with the front end of the proximal end portion 20*a* and extends in the Z direction along the side wall portion 16 and upward. The contact portion 20*c* is located contiguously with the upper end of the intermediate portion 20*b*, extends into the accommodating portion 18, and comes into contact with the connection terminal portion 61 of the FPC 60 in the accommodating portion 18 (see FIGS. 11B and 11D). The contact portion 20*c* extends from a position located contiguously with the intermediate portion 20*b* into the accommodating portion 18 through the through hole 16*a*. The contact portion 20*c* has a first part 20*d* extending in the X direction while being in contact with the upper wall portion 17, a second part 20*e* located contiguously with the front end of the first part 20*d* and extending forward while being inclined in the downward direction, and a third part 20*f* located contiguously with a contact region 20*g*, which is the front end of the second part 20*e*, and extending forward while being inclined in the upward direction. The contact region 20*g* is the lowermost part of the contact portion 20*c* and may be configured to come into contact with the connection terminal portion 61 of the FPC 60 (see FIG. 11D).

As illustrated in FIGS. 3A to 3E and FIGS. 4A and 4B, the fixing portions 12 are located contiguously with parts near the rear ends of both Y-direction end portions of the main body portion 11, that is, parts near the rear ends of the side wall portion 14 and the side wall portion 15. The fixing portions 12 include parts to which the fixing metal fitting 30 is attached. The configurations of the fixing portions 12 provided on the Y-direction outer sides of the side wall portion 14 and the side wall portion 15 (sides away from the center of the main body portion 11 in the Y direction) may be identical to each other. Accordingly, the fixing portion 12 may be located on the Y-direction outer side of the side wall portion 14, and the fixing portion 12 may be located on the Y-direction outer side of the side wall portion 15.

The fixing portion 12 has a base portion 12*a* and an inclined portion 12*b*. The base portion 12*a* is a substantially rectangular parallelepiped part located contiguously with the X-direction middle portion of the side wall portion 14. The inclined portion 12*b* is a part located contiguously with the rear end of the base portion 12*a* and extending rearward. The rear end of the inclined portion 12*b* is positioned behind the side wall portion 16 (see FIG. 3A). The inclined portion 12*b* is formed so as to have a wall thickness gradually decreasing (length decreasing in the Z direction) rearward, that is, so as to be inclined rearward and downward (see FIG. 4A).

Figure 4B:
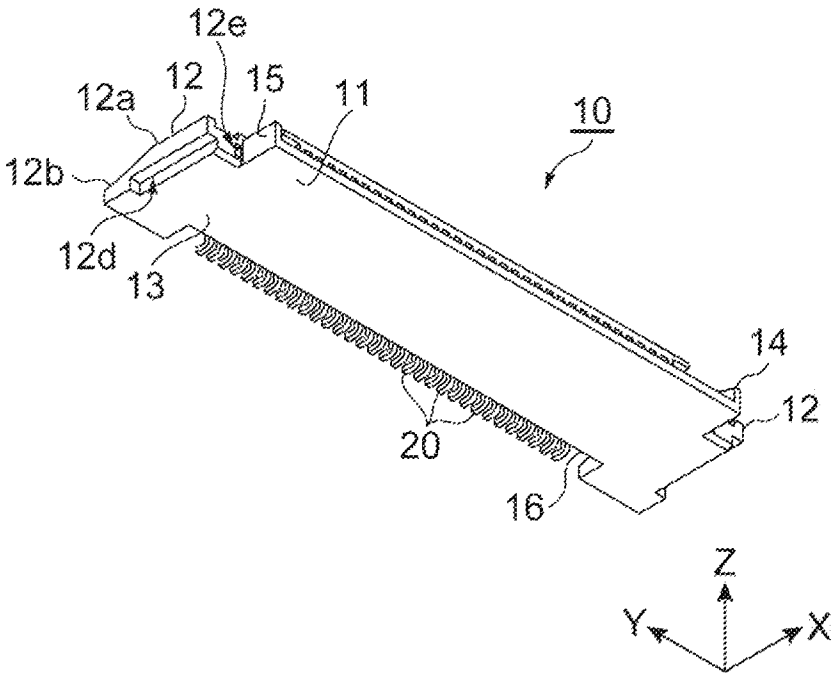
Figure 4A:
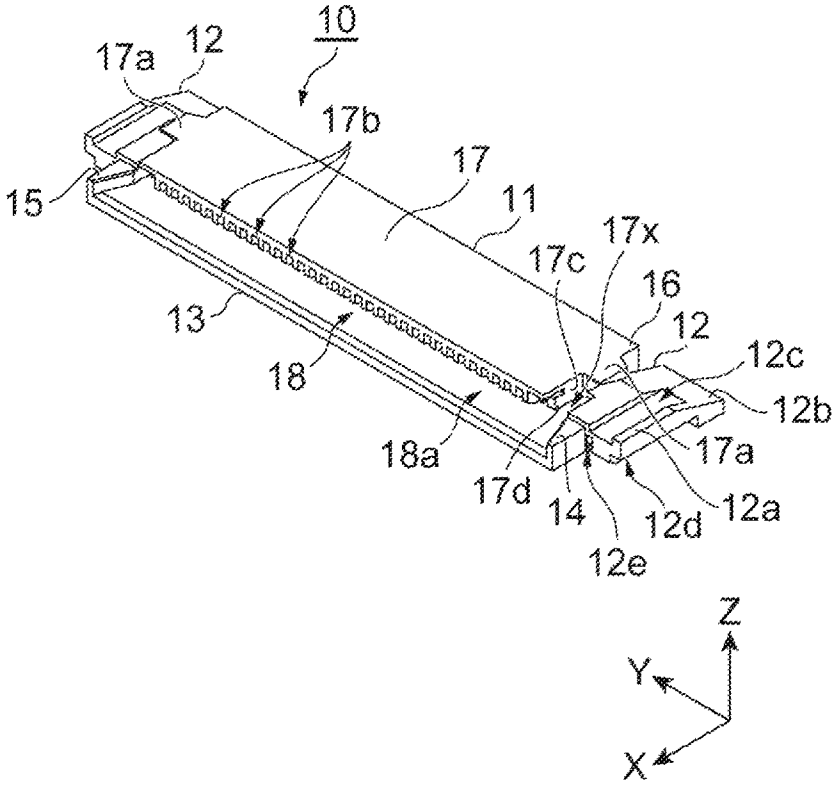
Figure 6A:
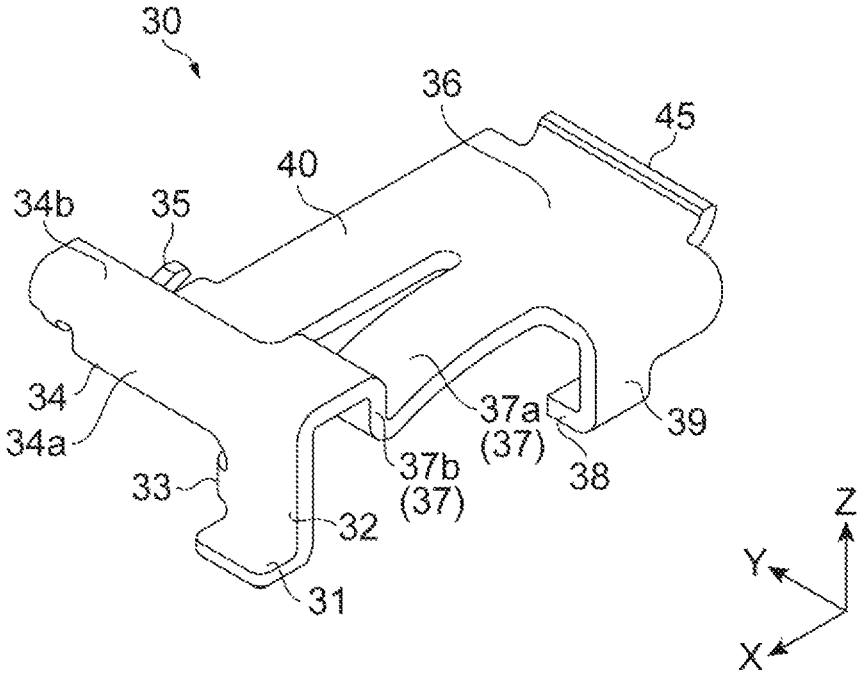

A first recess 12*c*, a second recess 12*d*, and a hole portion 12*e* are formed in the fixing portion 12 (see FIGS. 4A and 4B). The first recess 12*c* is a part recessed in the Z direction (downward) in the upper surfaces of the base portion 12*a* and the inclined portion 12*b*. The first recess 12*c* is formed from the front end of the base portion 12*a* to the vicinity of the middle of the inclined portion 12*b* in the X direction. As illustrated in FIGS. 1 and 6A, the first recess 12*c* accommodates a second intermediate portion 37 of the fixing metal fitting 30. The second recess 12*d* is a part recessed toward the upper surface (Z direction, or upward) in the lower surfaces of the base portion 12*a* and the inclined portion 12*b*. The second recess 12*d* is formed from the front end of the base portion 12*a* to the vicinity of the middle of the inclined portion 12*b* in the X direction at a part near the Y-direction outer sides of the base portion 12*a* and the inclined portion 12*b*. As illustrated in FIGS. 1 and 6A, a second fixing portion 38 of the fixing metal fitting 30 is engaged with the second recess 12*d*. The hole portion 12*e* is a hole formed in the base portion 12*a* directly below the region where the first recess 12*c* is formed. The hole portion 12*e* extends rearward from the front end of the base portion 12*a*. A first fixing portion 33 (see FIG. 6B) of the fixing metal fitting 30 is inserted into the hole portion 12*e*.

(Fixing Metal Fittings)

Next, the fixing metal fittings 30 will be described in further detail with reference to FIGS. 5A to 5E, FIGS. 6A and 6B, FIGS. 7A to 7C, FIGS. 8A to 8C, and FIGS. 12A and 12B.

As illustrated in FIG. 1, the fixing metal fittings 30 fix the electrical connector 1 (for example, the housing 10) to the wiring substrate 50 by covering the upper portions of the fixing portions 12 and being fixed to the wiring substrate 50. The configurations of the fixing metal fittings 30 may be identical to each other. Accordingly, the fixing metal fitting 30 provided in one fixing portion 12 will be described below.

The fixing metal fitting 30 is made of, for example, a thin plate-shaped metal member. As illustrated in FIGS. 5A to 5E and FIGS. 6A and 6B, the fixing metal fitting 30 has a connecting portion 31, a first intermediate portion 32, the first fixing portion 33, the reinforcing portion 34, a ground contact portion 35, an operation portion 36, the second intermediate portion 37, the second fixing portion 38, a third intermediate portion 39, the fourth intermediate portion 40, and a locking portion 41.

The connecting portion 31 may be located on the wiring substrate 50 and connected to the wiring substrate 50 (see FIG. 1). When the connecting portion 31 is connected to the wiring substrate 50, the connecting portion 31 may be provided on the Y-direction outer side of the fixing metal fitting 30 (side away from the main body portion 11, as illustrated in FIG. 1). The first intermediate portion 32 may be configured to interconnect the connecting portion 31 and the reinforcing portion 34. The first intermediate portion 32 is located contiguously with the rear end of the connecting portion 31 and extends upward. The first fixing portion 33 may be located contiguously with the side surface on the Y-direction inner side of the first intermediate portion 32 (side approaching the main body portion 11 from the connecting portion 31) and extending rearward (see FIG. 6B). The first fixing portion 33 fixes the fixing metal fitting 30 to the housing 10. For example, the first fixing portion 33 fixes the fixing metal fitting 30 to the housing 10 by being inserted into the hole portion 12*e* of the fixing portion 12 (see FIG. 4A).

As illustrated in FIG. 12A, the reinforcing portion 34 may be located in the upper wall portion 17 of the main body portion 11 of the housing 10 partitioning the accommodating portion 18. In some examples, the reinforcing portion 34 is provided on the surface of the housing 10 where the opening 18*a* of the accommodating portion 18 is formed (see FIG. 12A). As described above, the fixing metal fittings 30 are provided in the fixing portions 12, and thus the reinforcing portions 34 are provided in both Y-direction end portions of the surface where the opening 18*a* is formed, the Y direction being the extension direction of the upper wall portion 17 (see FIG. 7A).

Figure 6B:
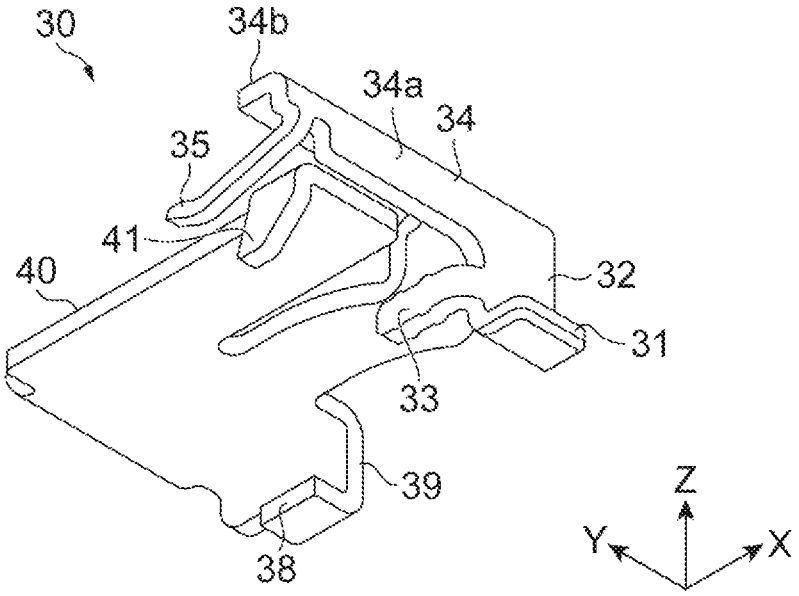

As illustrated in FIGS. 6A and 6B, the reinforcing portion 34 is located contiguously with the upper end of the first intermediate portion 32 and extends inward in the Y direction (to the side that approaches the main body portion 11 from the connecting portion 31). The reinforcing portion 34 has a first part 34*a* located contiguously with the upper end of the first intermediate portion 32 and extending in the Z direction and the Y direction and the second part 34*b* located contiguously with the upper end of the first part 34*a* and extending in the X direction and the Y direction. In some examples, the first part 34*a* extends in a direction perpendicular to the main surface of the FPC 60 (see FIG. 12B) and the second part 34*b* extends in a direction parallel to the main surface of the FPC 60.

The second part 34*b* of the reinforcing portion 34 may be located on the upper surface of the second part 17*d* (see FIG. 4A) provided at both Y-direction ends of the upper wall portion 17 of the housing 10. As a result, the reinforcing portion 34 is attached to the upper wall portion 17. When the reinforcing portion 34 is attached to the upper wall portion 17, the first part 34*a* of the reinforcing portion 34 extends downward beyond the lower end or lower surface of the upper wall portion 17 (see FIG. 12A). In some examples, as illustrated in FIG. 12A, a height HW of the lower end of the upper wall portion 17 is higher than a height HR of the lower end of the first part 34*a* of the reinforcing portion 34 as viewed from the bottom surface of the housing 10.

The reinforcing portion 34 may be connected to the connecting portion 31 via the first intermediate portion 32 as described above. In some examples, the reinforcing portion 34 is located on the extension line of the connecting portion 31 disposed in a stable state by being connected to the wiring substrate 50 in order to improve the reinforcing performance of the reinforcing portion 34 at a time when, for example, the FPC 60 in the accommodating portion 18 is lifted (upheaved) in the upward direction.

Figure 14A:
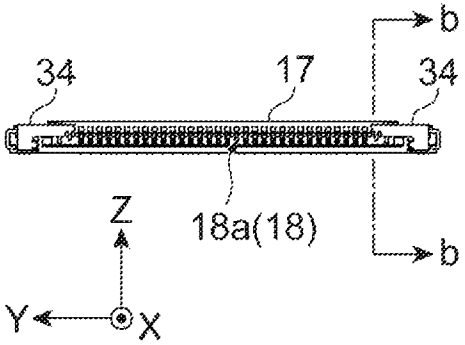
Figure 14B:
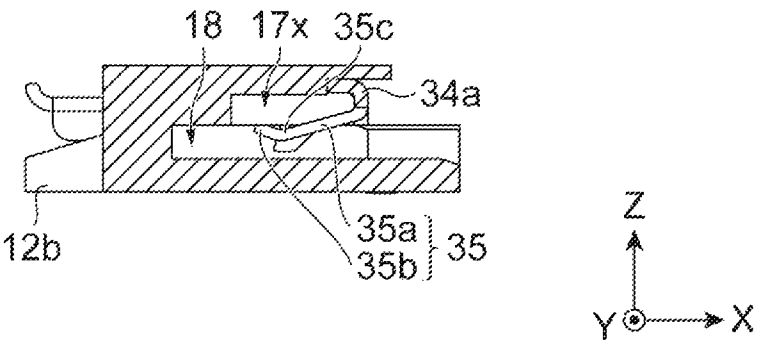
Figure 14C:
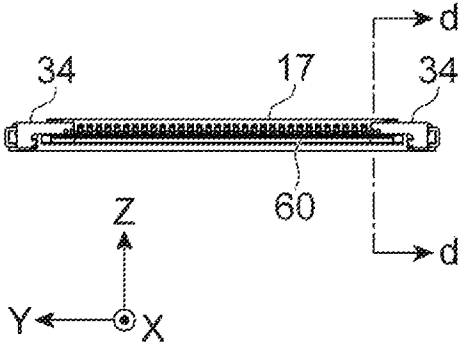

The ground contact portion 35 may be configured to come into contact with a ground terminal portion 62 of the FPC 60. The ground contact portion 35 extends in the X direction (rearward) and is located contiguously with the lower end of the end portion of the first part 34*a* that is on the side which is opposite to the side located contiguously with the first intermediate portion 32 (Y-direction inner end portion). As illustrated in FIG. 14B, the ground contact portion 35 has a first part 35*a* located contiguously with the lower end of the first part 34*a* and extending rearward while being inclined in the downward direction and a second part 35*b* located contiguously with a contact region 35*c*, which is the rear end of the first part 35*a*, and extending rearward while being inclined in the upward direction. The contact region 35*c* is the lowermost part of the ground contact portion 35 and may be configured to come into contact with the ground terminal portion 62 of the FPC 60 (see FIG. 14D).

The ground contact portion 35 may be located contiguously with the reinforcing portion 34 as described above. In some examples, the ground contact portion 35 corning into contact with the ground terminal portion 62 of the FPC 60 is formed integrally with the reinforcing portion 34 and by the same member. In addition, with the ground contact portion 35 extending in the X direction, which is the insertion direction of the FPC 60, the insertion of the FPC 60 can be guided by the ground contact portion 35 when the FPC 60 is inserted into the accommodating portion 18.

The second intermediate portion 37 may be located contiguously with the front end of the Y-direction outer end portion of the operation portion 36, extending forward from the operation portion 36, and connected to the rear end of the Y-direction outer end portion of the reinforcing portion 34 (for example, the second part 34*b*). The second intermediate portion 37 has a first part 37*a* located contiguously with the operation portion 36 and extending forward while being inclined in the downward direction from the operation portion 36 and a second part 37*b* located contiguously with the front end of the first part 37*a*, extending in the upward direction, and connected to the second part 34*b* of the reinforcing portion 34. The second intermediate portion 37 is accommodated in the first recess 12*c* of the housing 10 (see FIG. 4A) in a state where the fixing metal fitting 30 is attached to the fixing portion 12.

The fourth intermediate portion 40 may be located contiguously with the front end of the Y-direction inner end portion of the operation portion 36 and extending forward from the operation portion 36. The locking portion 41 is provided at the front end of the fourth intermediate portion 40. The fourth intermediate portion 40 extends forward from the operation portion 36 to a position close to the reinforcing portion 34. In some examples, the fourth intermediate portion 40 is not connected to the reinforcing portion 34. The fourth intermediate portion 40 is adjacent to the second intermediate portion 37 in the Y direction. In some examples, the fourth intermediate portion 40 and the second intermediate portion 37 are not located contiguously with each other in the Y direction. In this manner, the fourth intermediate portion 40 is not located contiguously with the second intermediate portion 37, the connecting portion 31, and the wiring substrate 50. Accordingly, the locking portion 41 provided in the fourth intermediate portion 40 can be readily displaced when the operation portion 36 is pressed.

Figure 13A:
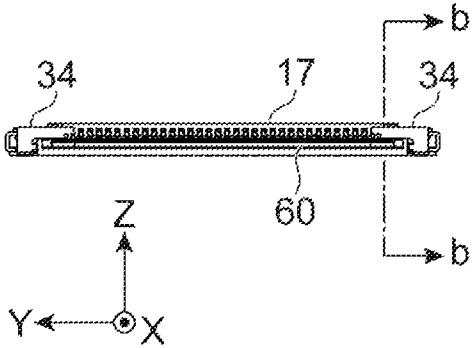
Figure 13B:
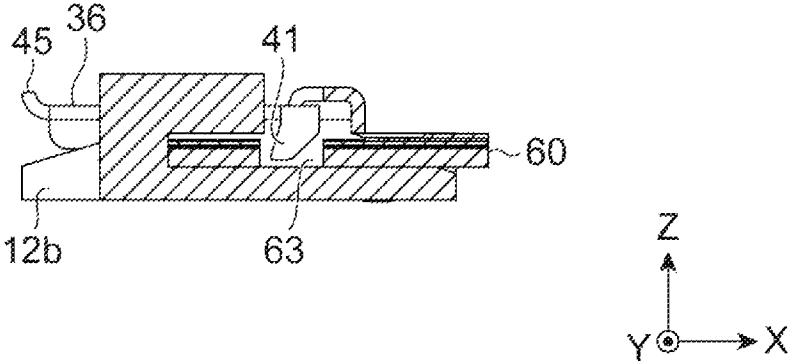
Figure 13C:
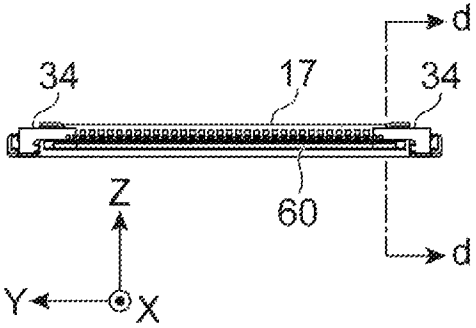

The locking portion 41 may be configured to lock the FPC 60 in the accommodating portion 18 (see FIG. 13B). The locking portion 41 may be contiguously located with the side surface on the Y-direction inner side of the front end portion of the fourth intermediate portion 40 and extending downward. In some examples, the locking portion 41 locks the FPC in the accommodating portion 18 by being engaged with a notch 63 of the FPC 60 (see FIG. 13B).

The operation portion 36 may be manually pressed. When the operation portion 36 is pressed, the operation portion 36 releases a locked state where the FPC 60 is locked by the locking portion 41 (see FIG. 13B) into an unlocked state (see FIG. 13D). The operation portion 36 is a plate-shaped portion provided at the rear end of the fixing metal fitting 30. An operation assistance portion 45 that is directed upward is provided at the rear end of the operation portion 36. When the operation portion 36 is pressed, for example by a worker or the like, the operation assistance portion 45 may be caught by the worker's hand to facilitate a pressing operation.

Figure 7A:
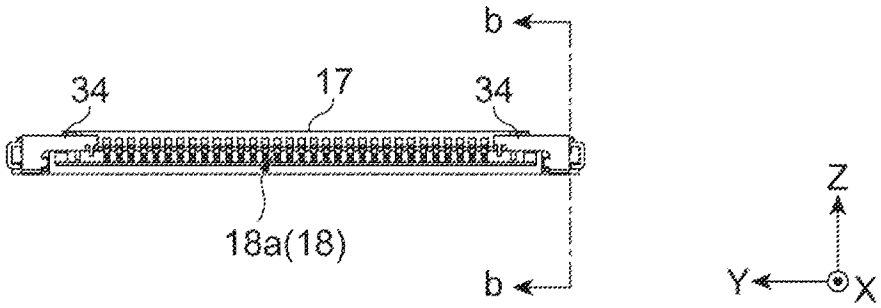
Figure 7C:
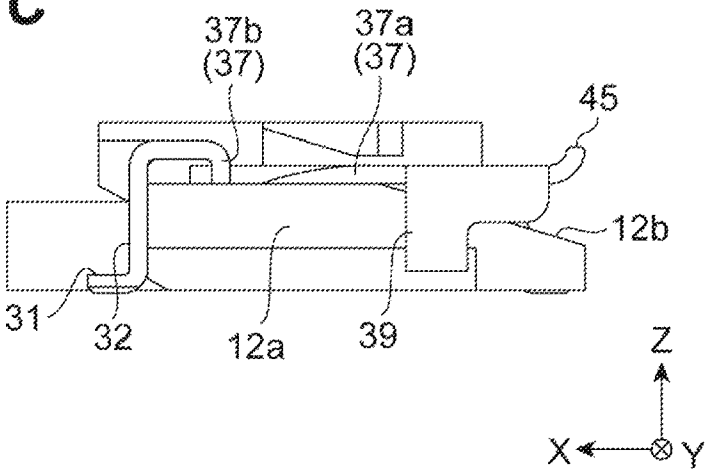
Figure 7B:
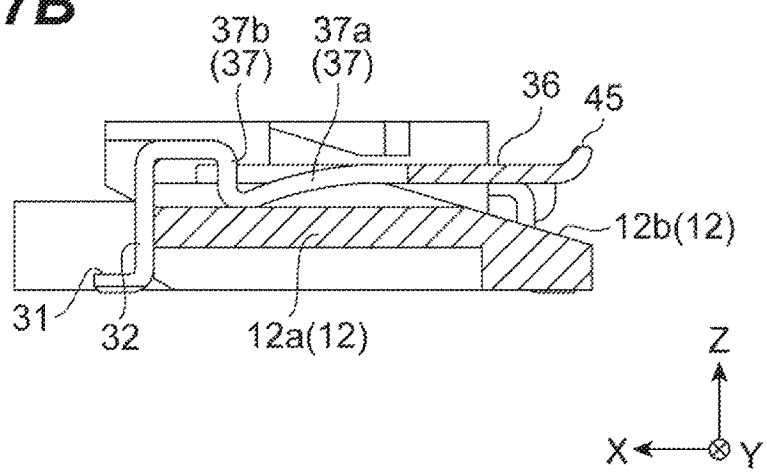
Figure 8A:
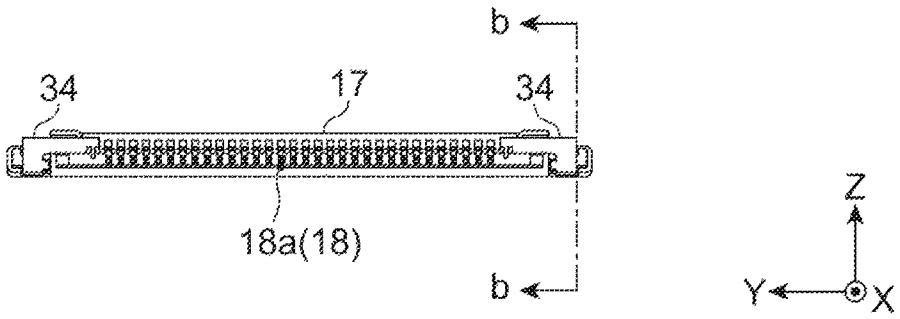
Figure 8C:
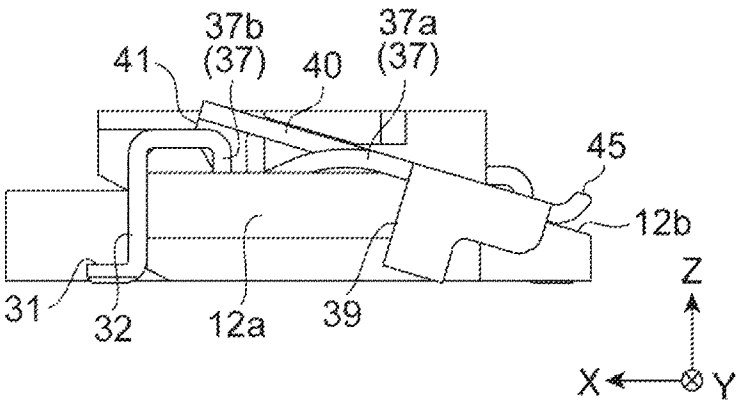
Figure 8B:
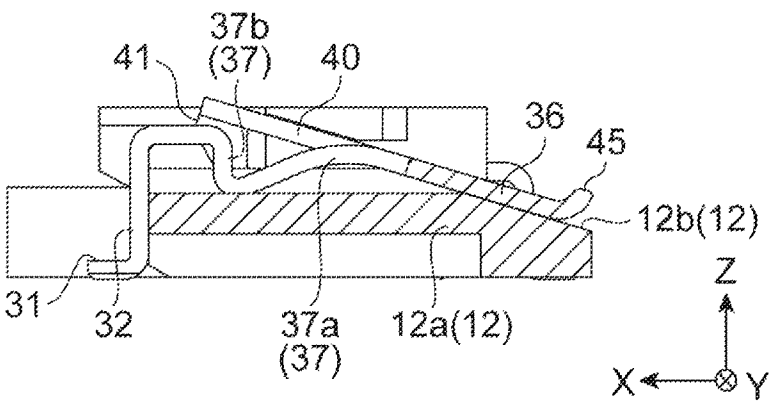

FIGS. 7A to 7C and FIGS. 8A to 8C are views illustrating an example unlocking operation. The locked state is illustrated in FIGS. 7A to 7C, and the unlocked state is illustrated in FIGS. 8A to 8C. As illustrated in FIGS. 7B and 7C, in the locked state, the operation portion 36 remains located away from the fixing portion 12. In the locked state, the locking portion 41 is engaged with the notch 63 of the FPC 60 (see FIG. 13B). From this state, the operation portion 36 is pressed downward and positioned along the inclined portion 12*b* of the fixing portion 12 as illustrated in FIGS. 8B and 8C. Then, the fourth intermediate portion 40 is inclined rearward with the contact point between the operation portion 36 and the inclined portion 12*b* as a fulcrum. As a result, the locking portion 41 (see FIG. 8C) connected to the operation portion 36 via the fourth intermediate portion 40 is displaced upward and a shift in state occurs from the locked state where the FPC 60 is locked by the locking portion 41 (see FIG. 13B) to the unlocked state (see FIG. 13D).

As illustrated in FIGS. 5A to 5E and FIGS. 6A and 6B, the third intermediate portion 39 may be located contiguously with the side surface on the Y-direction outer side of the front end portion of the operation portion 36 and extending downward. The third intermediate portion 39 covers the side surface of the fixing portion 12 from the outer side in the Y direction in a state where the fixing metal fitting 30 is attached to the fixing portion 12.

The second fixing portion 38 may be located contiguously with the lower end of the third intermediate portion 39 and extending inward in the Y direction. The second fixing portion 38 fixes the fixing metal fitting 30 to the housing 10 by an engagement with the second recess 12*d* of the fixing portion 12 (see FIGS. 4A and 4B). The second fixing portion 38 is engaged with the housing 10 from the lower surface of the housing 10, and then the housing 10 is sandwiched by the second fixing portion 38 and the operation portion 36 in order to prevent deformation of the fixing metal fitting 30 in a case where, for example, the fixing metal fitting 30 is lifted upward from below.

(Flexible Printed Circuits)

Figure 9B:
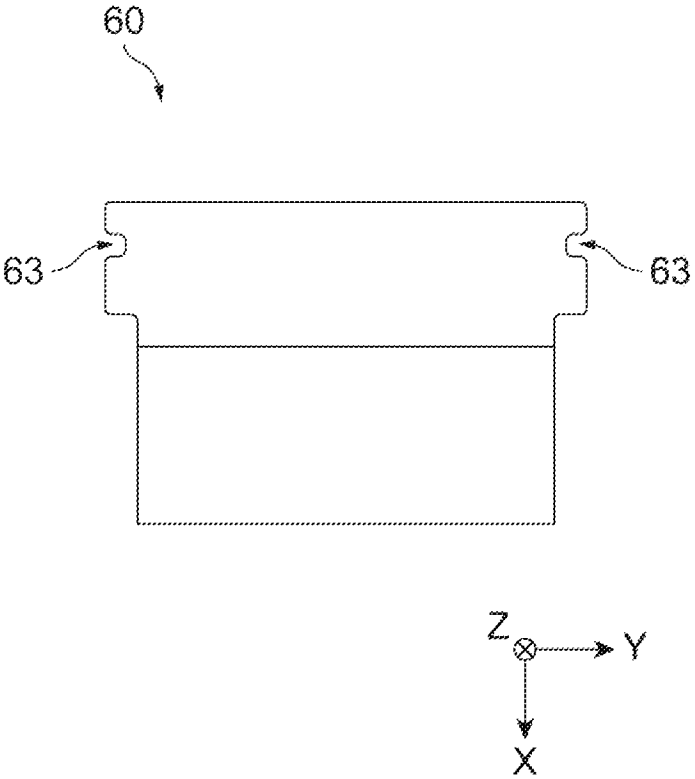
Figure 9A:
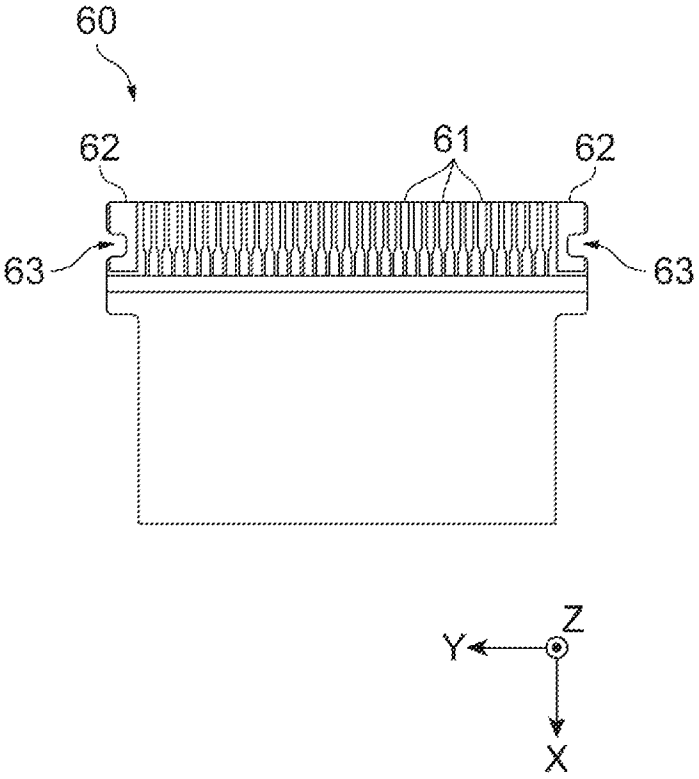
Figure 10:
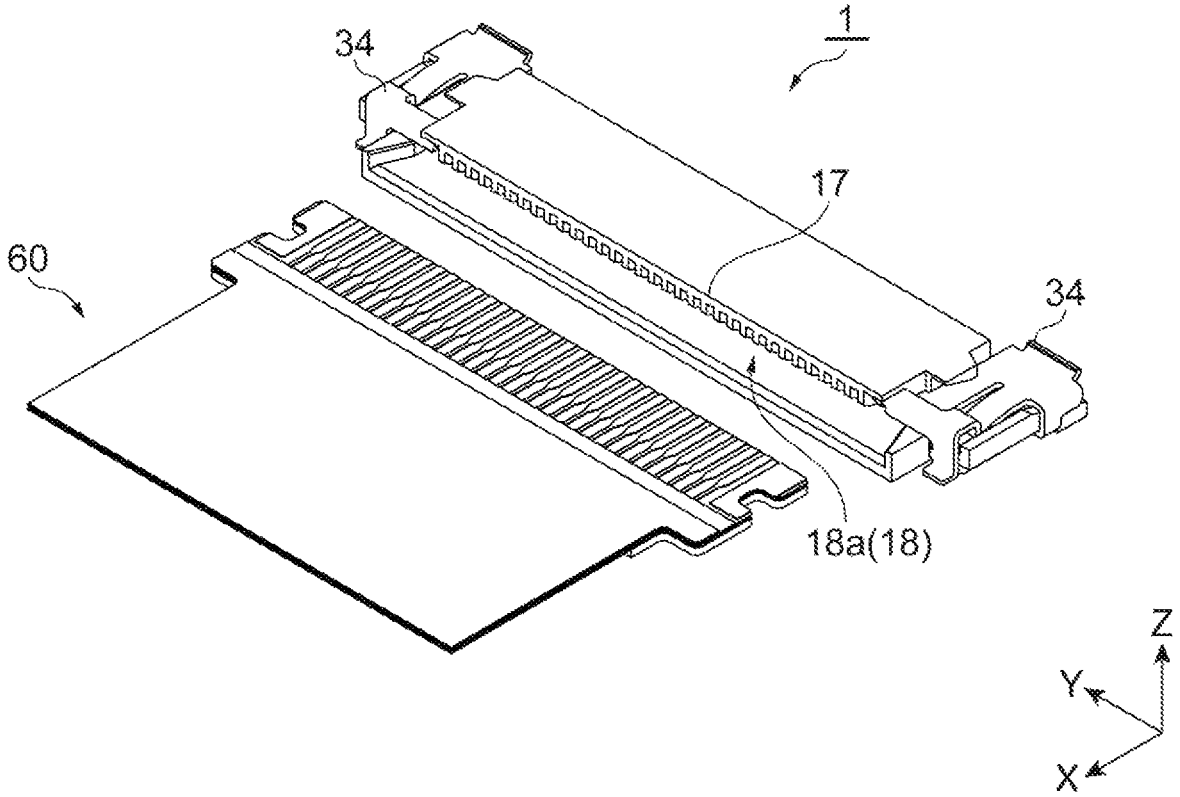
FIG. 10 is a perspective view illustrating the FPC being inserted into the electrical connector.

Next, the FPC 60 will be described with reference to FIGS. 9A, 9B and FIG. 10. The FPC 60 is a connection object accommodated in the accommodating portion 18 of the housing 10. As illustrated in FIGS. 9A and 9B, the FPC 60 has the plurality of connection terminal portions 61 provided so as to correspond to the plurality of conductive terminals 20. Additionally, the ground terminal portions 62 and 62 are provided in both Y-direction end portions so as to correspond to the ground contact portions 35 and 35, and the notch 63 is formed so as to partially notch both Y-direction end portions (regions where the ground terminal portions 62 and 62 are provided). As illustrated in FIG. 10, the FPC 60 is set such that the connection terminal portion 61 faces the opening 18*a* of the accommodating portion 18 and the FPC 60 is accommodated in the accommodating portion 18 with the opening 18*a* as an insertion port.

(Electrical Connection between Electrical Connector and FPC)

Next, an example electrical connection between the electrical connector 1 and the FPC 60 will be described in further detail with reference to FIGS. 11A to 11D and FIGS. 14A to 14D.

Figure 11D:
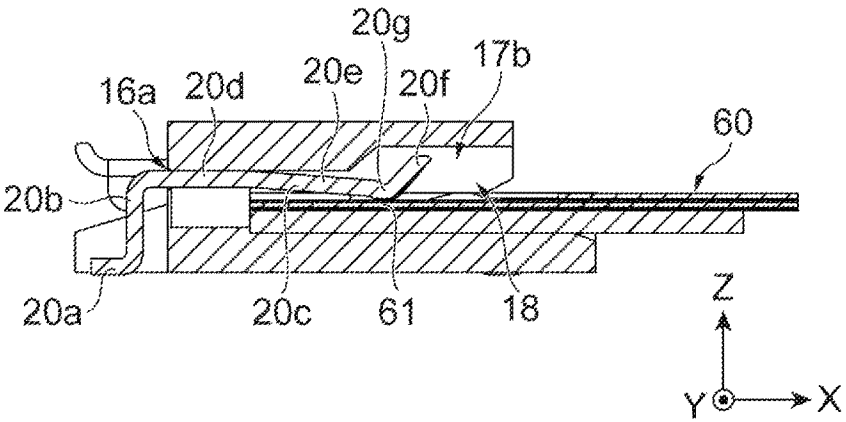

FIGS. 11A to 11D are views illustrating an example connection between the conductive terminal 20 of the electrical connector 1 and the connection terminal portion 61 of the FPC 60. As illustrated in FIG. 11B, in a state where the FPC 60 is not accommodated in the accommodating portion 18, the third part 20*f* is positioned close to the lower side of the accommodating recess 17*b*. As illustrated in FIG. 11D, in a state where the FPC 60 is accommodated in the accommodating portion 18, the contact region 20*g* comes into contact with the connection terminal portion 61 of the FPC 60. In some examples, the third part 20*f* may be positioned close to the upper side of the accommodating recess 17*b* by the contact portion 20*c* being pushed upward by the inserted FPC 60.

Figure 14D:
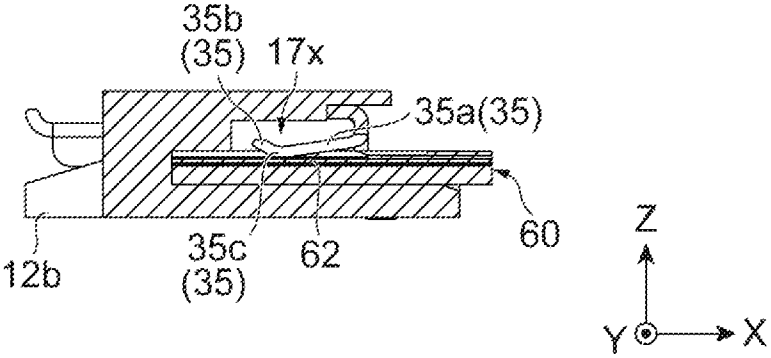
Figure 15A:
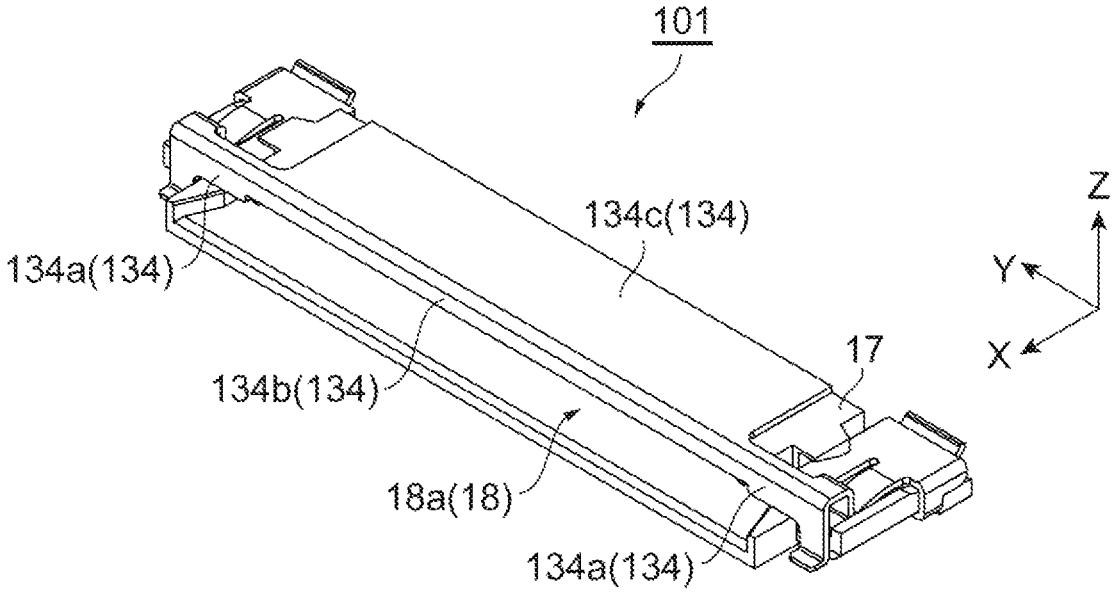
Figure 15B:
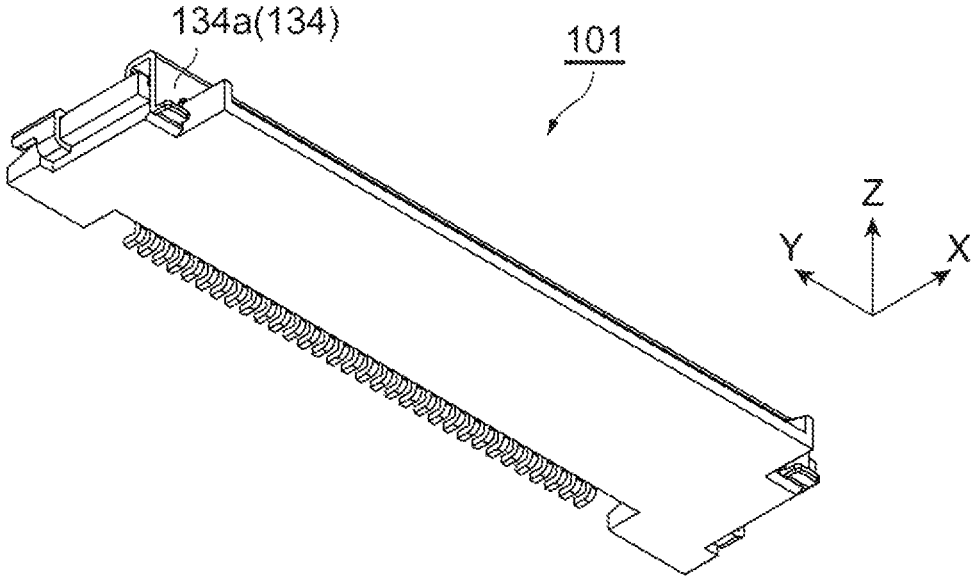
Figure 16A:
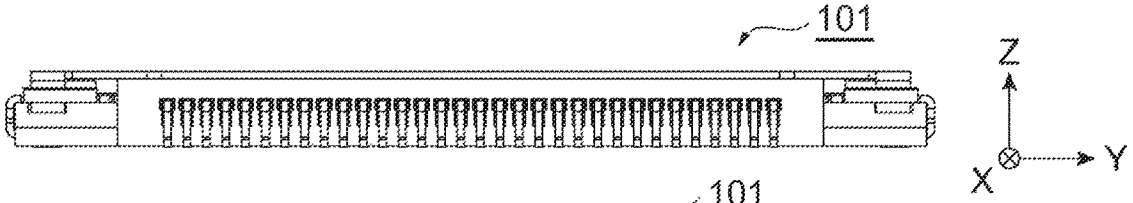
Figure 16B:
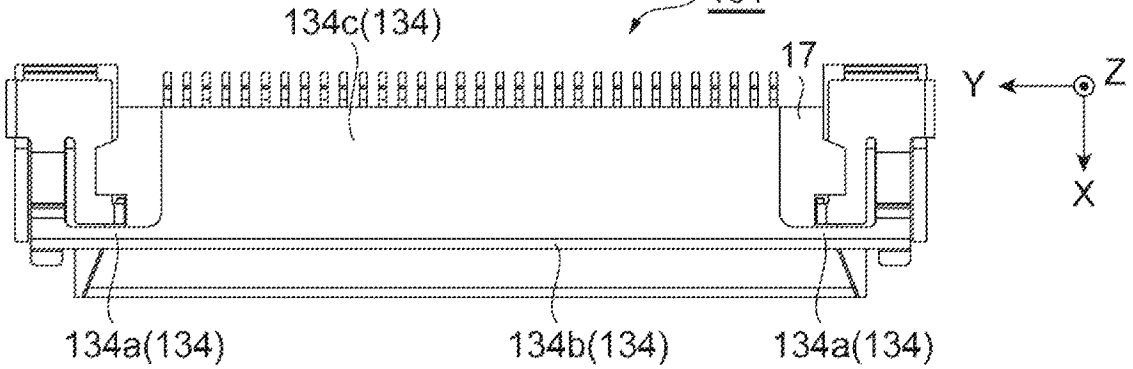
Figure 16C:
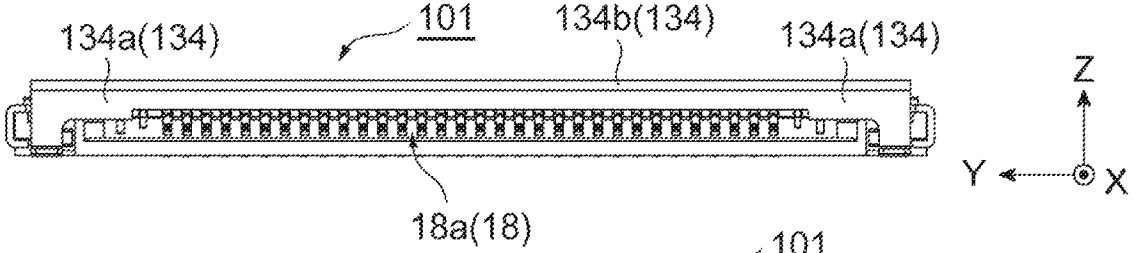
Figure 16D:
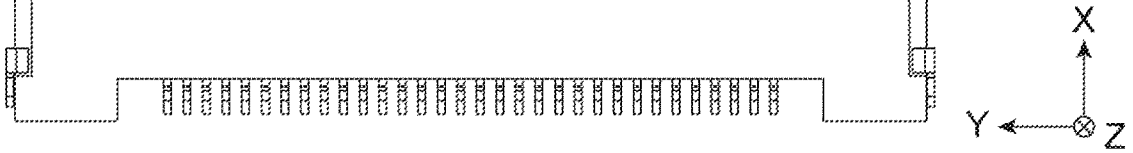
Figure 16E:
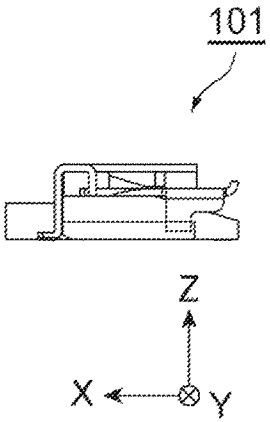

FIGS. 14A to 14D are views illustrating an example connection between the ground contact portion 35 of the electrical connector 1 and the ground terminal portion 62 of the FPC 60. As illustrated in FIG. 14B, in a state where the FPC 60 is not accommodated in the accommodating portion 18, the second part 35*b* is positioned below the accommodating space 17*x*. As illustrated in FIG. 14D, in a state where the FPC 60 is accommodated in the accommodating portion 18, the contact region 35*c* comes into contact with the ground terminal portion 62 of the FPC 60. In some examples, the second part 35*b* is positioned in the accommodating space 17*x* by the ground contact portion 35 being pushed upward by the inserted FPC 60.

(Locking of FPC by Electrical Connector)

Figure 13D:
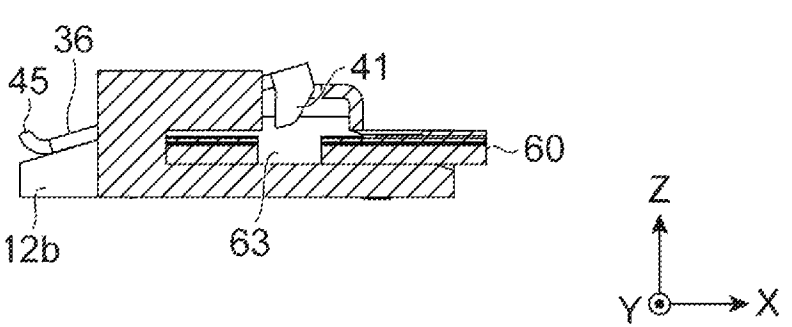

Next, an example locking operation of the FPC 60 by the electrical connector 1 will be described with reference to FIGS. 13A to 13D. As illustrated in FIG. 13B, in the electrical connector 1, the locking portion 41 of the fixing metal fitting 30 is engaged with the notch 63 of the FPC 60 and the FPC 60 is locked in the accommodating portion 18 as a result in a state where the FPC 60 is accommodated in the accommodating portion 18. The engagement between the notch 63 and the locking portion 41 may be automatically performed by insertion of the FPC 60 into the accommodating portion 18. From this state, the operation portion 36 is pressed downward as illustrated in FIG. 13D. Then, the operation portion 36 is positioned along the inclined portion 12*b* and the fourth intermediate portion 40 is inclined rearward with the contact point between the operation portion 36 and the inclined portion 12*b* as a fulcrum. As a result, the locking portion 41 connected to the operation portion 36 via the fourth intermediate portion 40 is displaced upward. Accordingly, the engagement between the locking portion 41 and the notch 63 is released and the locking of the FPC 60 by the electrical connector 1 is released.

An example operation of the electrical connector 1 will now be described.

The electrical connector 1 may include the plurality of conductive terminals 20, and the insulating housing 10 holding the plurality of conductive terminals 20 and having the accommodating portion 18 accommodating the FPC 60 provided with the plurality of connection terminal portions 61 electrically connected to the plurality of conductive terminals 20. Additionally, the electrical connector 1 may include the metallic reinforcing portion 34 (reinforcing portion 34 of the fixing metal fitting 30) provided in the upper wall portion 17 of the main body portion 11 of the housing 10 partitioning the accommodating portion 18.

In an example electrical connector accommodating a connection object such as an FPC, a strong force is applied to the housing of the electrical connector which may cause a terminal part of the accommodated connection object to be lifted in the upward direction, that is, in a case where so-called upheaval occurs. The upheaval may become more pronounced as the height of the electrical connector is reduced. In some examples, the metallic reinforcing portion 34 is provided in the upper wall portion 17 of the main body portion 11 of the housing 10 partitioning the accommodating portion 18 so that the force that is attributable to upheaval of the FPC 60 in the upward direction can be received by the reinforcing portion 34 as well as the housing 10 to protect the electrical connector 1.

The reinforcing portion 34 is provided on the surface of the housing 10 where the opening 18*a* of the accommodating portion 18 is formed. When the FPC 60 is upheaved, the FPC 60 may be configured to come into contact with the upper wall portion 17 on the surface where the opening 18*a* of the accommodating portion 18, which is an insertion port for the FPC 60, is formed. In some examples, the reinforcing portion 34 is provided on the surface where the opening 18*a* of the accommodating portion 18 is formed so that the force that is applied to the electrical connector 1 when the FPC 60 is upheaved can be appropriately received by the reinforcing portion 34 to protect the electrical connector 1.

The reinforcing portion 34 is provided in both width-direction (Y-direction) end portions of the surface where the opening 18*a* is formed and the width direction (Y direction) is the extension direction of the upper wall portion 17. By the reinforcing portion 34 being provided in both width-direction end portions of the upper wall portion 17, the force that is applied to the upper wall portion 17 when the FPC 60 is upheaved can be received in a balanced manner by the reinforcing portion 34 to protect the electrical connector 1. In addition, the reinforcing portion 34 may be located in both Y-direction end portions to facilitate contact between the conductive terminal 20 and the connection terminal portion 61 provided in the Y-direction middle portion of the FPC 60.

The reinforcing portion 34 extends in a direction perpendicular to the main surface of the FPC 60. Since the reinforcing portion 34 stretches in the direction of upheaval of the FPC 60 (the perpendicular direction described above), rigidity can be enhanced against the force that is applied to the electrical connector 1 as a result of upheaval of the FPC 60.

The reinforcing portion 34 has a part extending downward beyond the lower end of the upper wall portion 17. As a result, the reinforcing portion 34 comes into contact with the FPC 60 prior to the upper wall portion 17 of the housing 10 when the FPC 60 is upheaved in the upward direction. In some examples, the reinforcing portion 34 may be configured to receive the force that is attributable to upheaval of the FPC 60 in the upward direction to protect the electrical connector 1 (e.g., housing 10) from damage.

The reinforcing portion 34 may be located in the fixing metal fitting 30 that is configured to fix the housing 10 to the wiring substrate 50. As a result, the metallic reinforcing portion 34 may be provided with a reduced number of parts.

The fixing metal fitting 30 includes the locking portion 41 which is configured to lock the FPC 60 in the accommodating portion 18 and the operation portion 36 which is configured to release the locked state of the FPC 60. As a result, the FPC 60 may be maintained in the locked state within the accommodating portion 18 at a time when the FPC 60 is upheaved.

It is to be understood that not all aspects, advantages and features described herein may necessarily be achieved by, or included in, any one particular example. Indeed, having described and illustrated various examples herein, it should be apparent that other examples may be modified in arrangement and detail. Although the reinforcing portion 34 may be understood to extend downward beyond the lower end of the upper wall portion 17, in some examples the reinforcing portion may be selectively located above the lower end of the upper wall portion such that the reinforcing portion facilitates insertion of the FPC into the accommodating portion while maintaining the strength of the electrical connector.

In some examples, the plurality of conductive terminals 20 may be connected to the plurality of connection terminal portions 61 of the FPC 60. However, in other examples one conductive terminal and one connection terminal portion of the FPC may be provided instead. Additionally, the reinforcing portion 34 has been described as being provided on the surface where the opening 18*a* of the accommodating portion 18 is formed. However, in some examples the reinforcing portion may be provided in the accommodating portion. Still further, whereas the reinforcing portion 34 may be provided in both Y-direction end portions of the upper wall portion 17, in other examples, the reinforcing portion 34 may be provided in one of the end portions instead. Additionally, the reinforcing portion 34 may be provided in the Y-direction middle portion instead of the end portion.

As illustrated in FIGS. 15A and 15B and FIGS. 16A to 16E, an example electrical connector 101 may be provided with a reinforcing portion 134. The reinforcing portion 134 has a pair of first reinforcing members 134*a*, a second reinforcing member 134*b*, and a third reinforcing member 134*c*. Although the pair of first reinforcing members 134*a*, the second reinforcing member 134*b*, and the third reinforcing member 134*c* are denoted by different reference numerals, the pair of first reinforcing members 134*a*, the second reinforcing member 134*b*, and the third reinforcing member 134*c* may comprise integrally formed members. The pair of first reinforcing members 134*a* are provided in both Y-direction end portions of the surface where the opening 18*a* of the accommodating portion 18 is formed, the Y direction being the extension direction of the upper wall portion 17. The second reinforcing member 134*b* extends in the Y direction so as to interconnect the pair of first reinforcing members 134*a*. The third reinforcing member 134*c* is located contiguously with the second reinforcing member 134*b* and covers substantially the entire region of the upper surface of the upper wall portion 17 (for example, the entire region of the upper surface except for both width-direction end portions).

As described above, the pair of first reinforcing members 134*a* may be provided in both end portions of the opening-formed surface and the second reinforcing member 134*b* extending in the width direction may be provided so as to interconnect the pair of first reinforcing members 134*a*. As a result, when the connection object (FPC) is upheaved, the force that is applied to both end portions of the upper wall portion 17 can be received by the pair of first reinforcing members 134*a* and the force that is applied to the middle portion of the upper wall portion 17 can be received by the second reinforcing member 134*b*. Accordingly, the force that is applied to the upper wall portion 17 can be received in a more balanced manner by the reinforcing portion 134 to protect the electrical connector 101 from damage. The damage suppression effect that is obtained by including the second reinforcing member 134*b* may become more pronounced in a case where the width-direction (Y-direction) length of the housing 10 has increased with the number of contacts. In addition, since the reinforcing portion 134 includes the third reinforcing member 134*c* covering the upper surface of the upper wall portion 17, the upper wall portion 17 to which a force is applied when the connection object (FPC) is upheaved can be reinforced in a more effective manner to protect the electrical connector 101 from damage.

What is claimed is:

1. An electrical connector comprising:

one or more contacts;

an insulating housing holding the one or more contacts and including an accommodating portion to accommodate a plate-shaped connection object provided with one or more connection terminal portions configured to be electrically connected to the one or more contacts; and a metallic reinforcing portion located in an upper wall portion of the housing that partitions the accommodating portion, wherein the reinforcing portion is located on a surface of the housing where an opening of the accommodating portion is formed, wherein the reinforcing portion is located in two end portions of the surface of the housing in a width direction, the width direction being an extension direction of the upper wall portion, and wherein the reinforcing portion includes a pair of first reinforcing members located in the two end portions of the surface of the housing and a second reinforcing member extending in the width direction so as to interconnect the pair of first reinforcing members.

2. The electrical connector according to claim 1, wherein the reinforcing portion further includes a third reinforcing member located contiguously with the second reinforcing member and covering an upper surface of the upper wall portion.

3. The electrical connector according to claim 1, wherein the reinforcing portion extends in a direction perpendicular to a main surface of the connection object.

4. The electrical connector according to claim 3, wherein the reinforcing portion includes a part extending downward beyond a lower surface of the upper wall portion.

5. The electrical connector according to claim 3, wherein the reinforcing portion is selectively located above a lower surface of the upper wall portion.

6. An electrical connector comprising:

one or more contacts;

an insulating housing holding the one or more contacts and including an accommodating portion to accommodate a plate-shaped connection object provided with one or more connection terminal portions configured to be electrically connected to the one or more contacts;

a metallic reinforcing portion located in an upper wall portion of the housing that partitions the accommodating portion, wherein the reinforcing portion is formed in a fixing metal fitting configured to fix the housing to a substrate; and a fixing portion located at one end of a main body of the housing, wherein the fixing metal fitting is attached to the fixing portion.

7. The electrical connector according to claim 6, wherein the fixing metal fitting includes a locking portion configured to lock the connection object in the accommodating portion in a locked state and an operation portion configured to release the connection object from the locked state.

8. The electrical connector according to claim 7, wherein the locking portion is configured to engage a notch in the plate-shaped connection object in the locked state, and wherein the operation portion is configured to disengage the locking portion from the notch.

9. The electrical connector according to claim 6, wherein the fixing portion includes a base portion and an inclined portion having a decreasing wall thickness.

10. The electrical connector according to claim 6, wherein the fixing portion includes one or more recessed areas and a hole portion to engage the fixing metal fitting.

11. The electrical connector according to claim 1, wherein the plate-shaped connection object comprises a flexible printed circuit.

12. The electrical connector according to claim 1, further comprising a ground contact portion located adjacent the reinforcing portion, the ground contact portion configured to contact a ground terminal portion of the plate-shaped connection object.

13. The electrical connector according to claim 12, wherein the reinforcing portion extends in a direction of upheaval that is perpendicular to a main surface of the connection object, and wherein the ground contact portion extends perpendicular to the direction of upheaval.

14. The electrical connector according to claim 13, wherein the ground contact portion is configured to guide the plate-shaped connection object into the accommodating portion.

15. An electrical connector comprising:

a plurality of electrical contacts;

an insulating housing including an accommodating portion that forms an opening to receive a plate-shaped printed circuit provided with connection terminals configured to be electrically connected to the plurality of electrical contacts located in the housing;

a reinforcing portion attached to an upper surface of the opening of the accommodating portion, wherein the reinforcing portion extends in a direction substantially perpendicular to a main surface of the printed circuit; and a metal fitting configured to fix the housing to a substrate, wherein the reinforcing portion is formed in the metal fitting, and wherein the metal fitting includes a locking portion configured to lock the printed circuit in the opening of the accommodating portion in a locked state and an unlocking portion configured to release the printed circuit from the locked state.

16. The electrical connector according to claim 15, further comprising a ground contact located adjacent the reinforcing portion, the ground contact configured to contact a ground terminal of the plate-shaped printed circuit.

17. The electrical connector according to claim 15, further comprising a fixing portion located at one end of a main body of the housing, wherein the metal fitting is attached to the fixing portion.

18. The electrical connector according to claim 15, wherein the reinforcing portion includes a pair of first reinforcing members located in the upper surface of the opening and a second reinforcing member extending in the direction that is substantially perpendicular to the main surface of the printed circuit so as to interconnect the pair of first reinforcing members.

19. The electrical connector according to claim 6, further comprising a ground contact portion located adjacent the reinforcing portion, the ground contact portion configured to contact a ground terminal portion of the plate-shaped connection object.

20. The electrical connector according to claim 6, wherein the reinforcing portion is located in two end portions of a surface of the housing in a width direction, and wherein the reinforcing portion includes a pair of first reinforcing members located in the two end portions and a second reinforcing member extending in the width direction so as to interconnect the pair of first reinforcing members.

* * * * *